US010247502B2

(12) United States Patent
Kilic

(10) Patent No.: US 10,247,502 B2
(45) Date of Patent: Apr. 2, 2019

(54) SAFETY PIN MECHANISM IN DOUBLE ACTION TRIGGERS

(71) Applicant: SAMS UN YURT SAVUNMA SANAYI VE TICARET A. S., Samsun (TR)

(72) Inventor: Recep Kilic, Istanbul (TR)

(73) Assignee: SAMS UN YURT SAVUNMA SANAYI VE TICARET A. S., Samsun (TR)

( * ) Notice: Subject to any disclaimer, the term of this patent is extended or adjusted under 35 U.S.C. 154(b) by 27 days.

(21) Appl. No.: 15/518,549

(22) PCT Filed: Dec. 28, 2016

(86) PCT No.: PCT/TR2016/050551
§ 371 (c)(1),
(2) Date: Apr. 12, 2017

(87) PCT Pub. No.: WO2018/026336
PCT Pub. Date: Feb. 8, 2018

(65) Prior Publication Data

US 2018/0238651 A1 Aug. 23, 2018

(30) Foreign Application Priority Data

Aug. 3, 2016 (TR) ..... a 2016/10866

(51) Int. Cl.
*F41A 17/46* (2006.01)

(52) U.S. Cl.
CPC ..... *F41A 17/46* (2013.01)

(58) Field of Classification Search
CPC ..... F41A 17/46
USPC ..... 42/70.06
See application file for complete search history.

(56) References Cited

U.S. PATENT DOCUMENTS 1,410,265 A * 3/1922 Pedersen ..... F41A 3/32 89/145
2,525,886 A * 10/1950 Fraser ..... F41A 17/20 42/70.03
2,635,380 A * 4/1953 Baker ..... F41A 17/22 42/70.06
4,203,348 A * 5/1980 Sokolovsky ..... F41A 17/38 42/70.04
4,300,301 A * 11/1981 Morrison ..... F41A 17/46 42/70.06
4,391,058 A * 7/1983 Casull ..... F41A 19/30 42/69.02
4,428,138 A * 1/1984 Seecamp ..... F41A 19/48 42/70.02
5,105,569 A * 4/1992 Straitiff ..... F41A 3/02 42/2
5,402,593 A * 4/1995 Lenkarski ..... F41A 17/22 42/70.06

(Continued)

FOREIGN PATENT DOCUMENTS

DE 10152071 A1 5/2003

OTHER PUBLICATIONS

PCT International Search Report of PCT/TR2016/050551, dated Feb. 24, 2017, ISA/European Patent Office.

*Primary Examiner* — Michelle Clement
(74) *Attorney, Agent, or Firm* — Gokalp Bayramoglu

(57) ABSTRACT

Invention is about the innovation in trigger locking pins which prevent the pistols to be fired involuntarily.

1 Claim, 5 Drawing Sheets

(56) References Cited

U.S. PATENT DOCUMENTS

| | | | | | |
|---|---|---|---|---|---|
| 5,678,342 | A * | 10/1997 | Felk | F41A 15/16 | 42/69.02 |
| D462,105 | S * | 8/2002 | Myers | D22/108 | |
| 6,499,243 | B1 * | 12/2002 | Herzog | F41A 17/066 | 42/70.06 |
| 6,615,529 | B1 * | 9/2003 | Seecamp | F41A 17/46 | 42/70.06 |
| 6,843,013 | B2 * | 1/2005 | Cutini | F41A 17/46 | 42/70.01 |
| D597,626 | S * | 8/2009 | Krieger | D22/108 | |
| 7,810,268 | B1 * | 10/2010 | McGarry | F41A 11/00 | 42/69.01 |
| 8,220,193 | B1 * | 7/2012 | Lynch | F41A 17/48 | 42/70.08 |
| 9,170,063 | B2 * | 10/2015 | Krieger | F41A 19/10 | |
| 9,383,153 | B2 * | 7/2016 | Nebeker | F41A 17/72 | |
| 9,441,897 | B2 * | 9/2016 | Mather | F41A 11/00 | |
| 9,488,428 | B2 * | 11/2016 | Olivias, Jr. | F41A 17/46 | |
| 9,810,496 | B2 * | 11/2017 | Kolev | F41A 3/12 | |
| 9,970,724 | B1 * | 5/2018 | Acker | F41A 17/46 | |
| 10,006,734 | B1 * | 6/2018 | Findlay | F41A 19/12 | |
| 10,060,693 | B2 * | 8/2018 | Bubits | F41A 17/46 | |
| 2003/0213159 | A1 | 11/2003 | Cutini et al. | | |
| 2009/0158634 | A1 * | 6/2009 | Bubits | F41A 17/22 | 42/70.06 |
| 2010/0024273 | A1 * | 2/2010 | Duperry | F41A 19/10 | 42/69.01 |
| 2015/0292828 | A1 * | 10/2015 | Nebeker | F41A 17/72 | 42/69.01 |
| 2016/0187092 | A1 * | 6/2016 | Mather | F41A 19/10 | 42/69.02 |

* cited by examiner

SAFETY PIN MECHANISM IN DOUBLE ACTION TRIGGERS

TECHNICAL FIELD

The present invention relates to the field of trigger locking pins which prevent the pistols to be fired involuntarily, in particular to a safety pin mechanism in double action triggers.

BACKGROUND

In the present locking mechanisms, the locking pin is placed in front of the trigger in single action and double action triggers. This structure can be summarized as: the trigger is divided longitudinally in two pieces and an additional piece is inserted between that two halves. The back side of that additional piece is designed to be rested to the tip of the part which the trigger moves in, in the trigger guard. Thus, the stopping of the trigger is provided after a certain distance by blocking it in involuntary actions (falling etc.). The mentioned mechanism is described in US20030213159 numbered patent application. The safety member (4) is placed between two trigger parts (2) and (2a). In an involuntarily action, the back side (12) of the safety member (4) is preventing the movement by hitting to the front wall (12a) (FIG. 3). But in a voluntarily pressing action the trigger mechanism returns to its normal function as shown in FIG. 8b.

SUMMARY

The present invention is aimed to resolve the problem sourced by the trigger locking pin mechanism in double action pistols. In a pressing movement with the invention, trigger locking pin, which is assembled on the trigger, does not disturb the user by not being separated from the trigger and it makes the user feel as touching a single trigger. Nonetheless, except the firing position, it provides the trigger lock to work.

Figure 1:
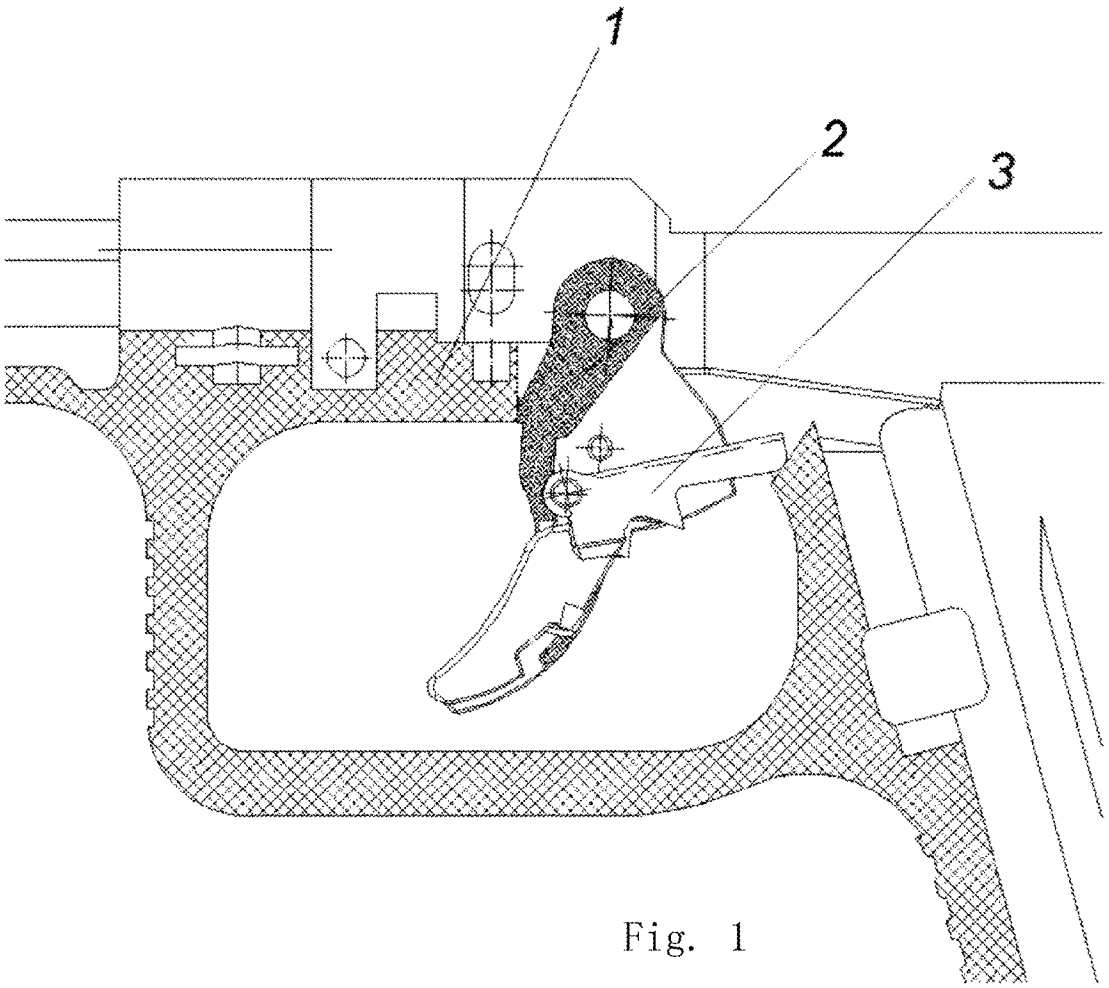
FIG. 1. Trigger Assembly Cross Section View
FIG. 2. Trigger Assembly Single Action View
FIG. 3. Locking Position of the Trigger Locking Pin
FIG. 4. Trigger Locking Pin Detailed View
FIG. 5. Trigger Locking Pin Isometric View The correspondence of the part numbers indicated in the figures are given below.

1. Body
2. Trigger
3. Trigger Locking Pin
31. (h) Axis
32. (m) Axis
33. Round core connection part
34. Pin's remaining part
35. Lower part
36. Basement part
37. Sharp tip
38. Lower base
39. Tip part

DETAILED DESCRIPTION OF THE EMBODIMENTS

Figure 2:
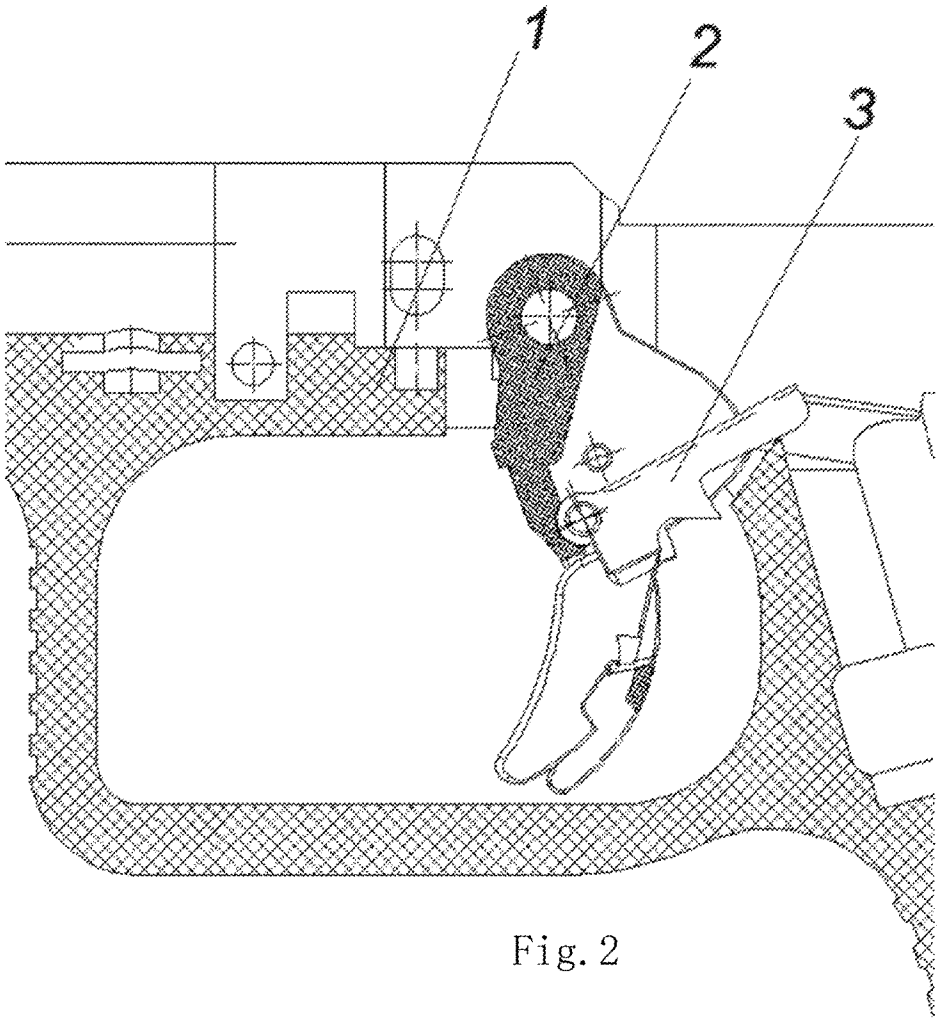

The present invention is about the innovation in trigger locking pins which prevent the pistols to be fired involuntarily. In the trigger safety mechanisms described in the patent application cited in "Background" section which is a brief summary of the present mechanism in market, the design causes a reaching problem to the trigger for the users. The problem which is tried to be overcame with our invention has its design based on specific measures and angles (Shown in FIG. 2). With that design the problem is solved by preventing the trigger locking pin (3) to move out of the trigger (2).

Figure 4:
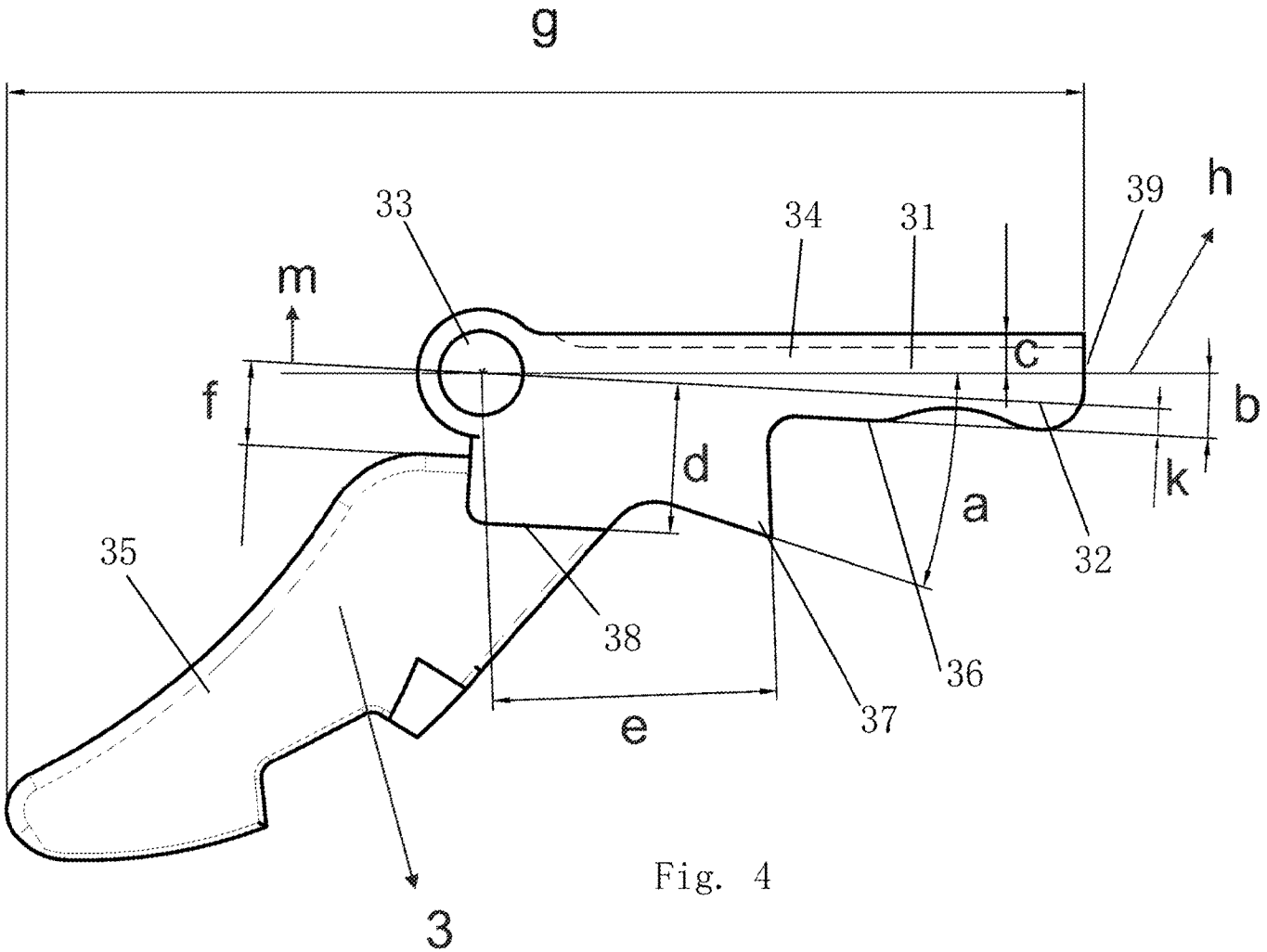
Figure 5:
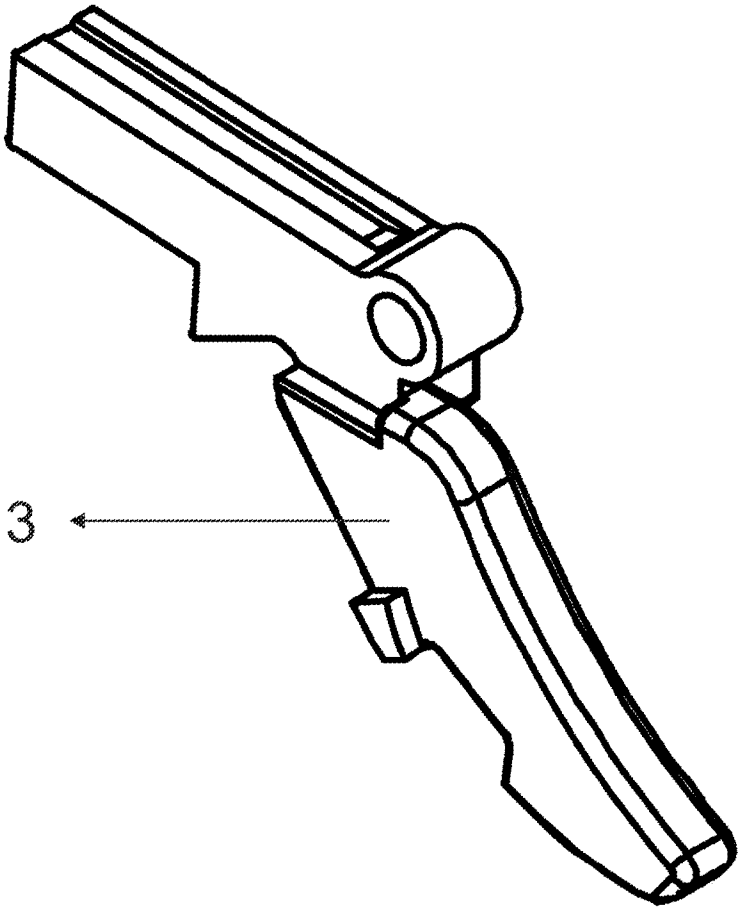

Refer to FIG. 4, the safety pin mechanism in double action trigger is scaled based on the (h) axis (31). Regarding to this; the (h) axis (31) is positioned 1.2 millimeters (c) below the top of the pin's remaining part (34) which is placed in the body (1) and it is also placed to pass through the center of the round core connection part (33) that the trigger locking pin (3) is connected to the trigger (2). The start of the basement part (36) of the trigger locking pin (3), which stays in the body (1) to provide the safety, is designed to make 3 degrees angle (b) with the (h) axis (31) and to be started from the 0.8 millimeters (k) below from the (m) axis (32). The sharp tip (37) of the trigger locking pin (3) is placed to make an 18 degrees angle (a) with the (h) axis (31). And the distance between the sharp tip (37) of the trigger locking pin (3) and the center of the round core connection part (33) that trigger locking pin (3) is connected to the trigger (2) is 8.5 millimeters (e). Thus, in involuntary trigger pressing actions, it holds on to the body (1) and prevents firing. The distance between the lower base (38) of the center of the round core connection part (33) that the trigger locking pin (3) is connected to the trigger (2) and the trigger locking pin (3) is 4.5 millimeters (d) regarding to the (m) axis (32) which is parallel to the basement. The start of the lower part (35), which forms the trigger from the pin, is placed 2.5 millimeters (f) away from the (m) axis (32). The distance between the front of the lower part (35), which forms the trigger, and the tip part (39) which stays in the body (1) has a total measure of 32.2 millimeters (g).

Figure 3:
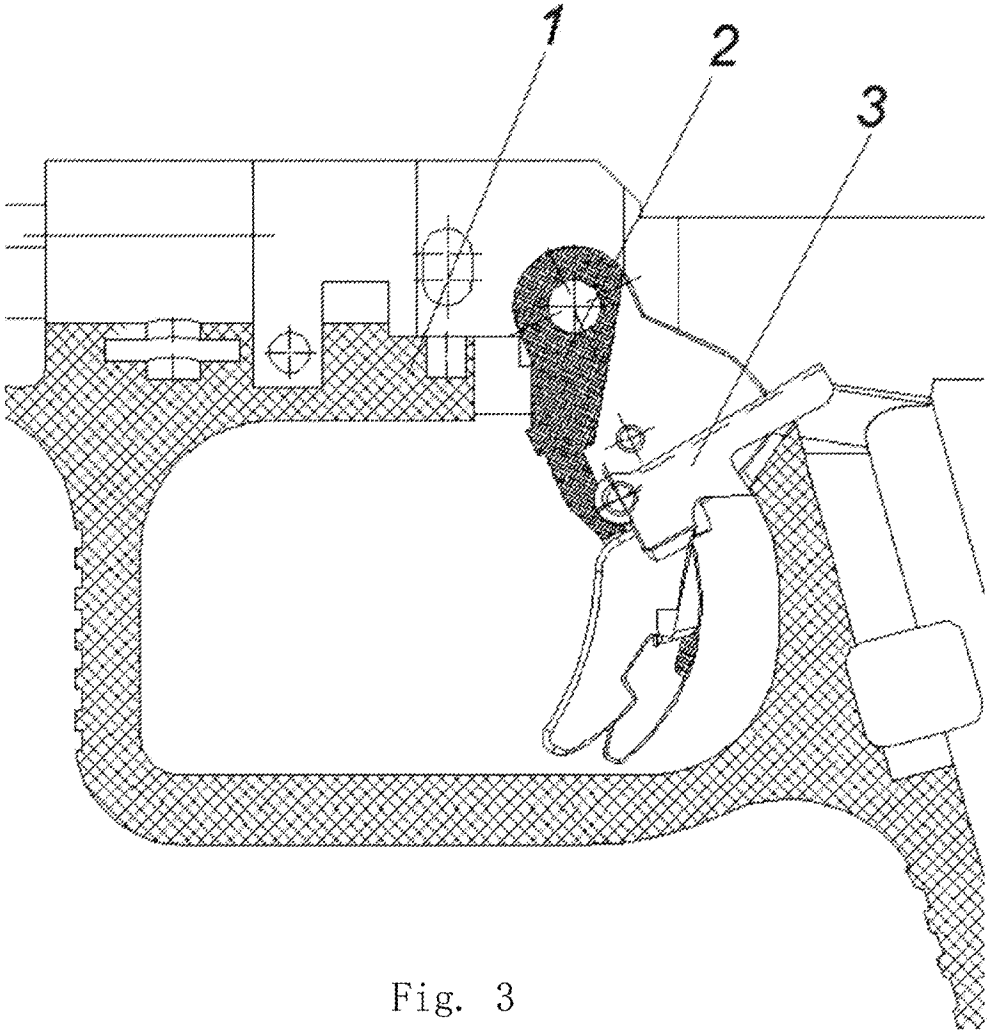

During the running of the trigger assembly in the single action position, the position of the trigger locking pin (3) is showed in front of the trigger in FIG. 3. In an involuntary usage of trigger (2), the trigger locking pin (3) is pressed to the body (1) and prevents firing as shown in FIG. 3. The locking mechanism works that way.

The invention claimed is:

1. A safety pin mechanism in double action triggers, comprising a body, a trigger and a trigger locking pin, wherein the trigger locking pin comprises a first axis, a second axis, a pin's remaining part, a round core connection part, a basement part, a sharp tip, a lower base, a lower part and a tip part, wherein the safety pin mechanism is scaled based on the first axis; a positioning of the first axis is 1.2 millimeters below a top of the pin's remaining part; the pin's remaining part is placed in the body; the first axis horizontally passes through a center of the round core connection part; the round core connection part is connected to the trigger and the trigger locking pin; a wall of the basement part of the trigger locking pin abuts in the body to provide a safety; the basement part is designed to make 3 degrees angle with the first axis; the basement part is 0.8 millimeters below the second axis; the sharp tip of the trigger locking pin is designed to make an 18 degrees angle with the first axis; a first distance between the sharp tip of the trigger locking pin and the center of the round core connection part is 8.5 millimeters; the sharp tip holds on the body, and the trigger locking pin is in front of the trigger in involuntary trigger pressing actions; a second distance between the lower base and the center of the round core connection part is 4.5 millimeters; the second axis is parallel to the basement part; the second axis passes through the center of the round core connection part; a top of the lower part is 2.5 millimeters away from the second axis; a third distance between the tip part and a front of the lower part is a total measure of 32.2 millimeters, wherein the lower part forms the trigger; and the tip part stays in the body.

* * * * *